United States Patent [19]

Naitoh et al.

[11] Patent Number: 4,928,637

[45] Date of Patent: May 29, 1990

[54] SYSTEM FOR COOLING AN INTERNAL COMBUSTION ENGINE INCLUDING A TURBOCHARGER

[75] Inventors: Takao Naitoh; Seidai Nakayama, both of Tokyo, Japan

[73] Assignee: Fuji Jukogyo Kabushiki Kaisha, Tokyo, Japan

[21] Appl. No.: 397,961

[22] Filed: Aug. 24, 1989

[30] Foreign Application Priority Data

Aug. 30, 1988 [JP] Japan ..... 63-216093

[51] Int. Cl.[5] ..... F01P 3/12

[52] U.S. Cl. ..... 123/41.31; 60/605.3

[58] Field of Search ..... 123/41.01, 41.2, 41.29, 123/41.31; 60/605.3

[56] References Cited

U.S. PATENT DOCUMENTS 4,561,387 12/1985 Körkemeier et al. ..... 60/605.3
4,608,827 9/1986 Hasegawa et al. ..... 123/41.31
4,739,619 4/1988 Koerkemeier ..... 123/41.31
4,829,939 5/1989 Veenemans et al. ..... 123/41.31

*Primary Examiner*—Noah P. Kamen
*Attorney, Agent, or Firm*—Beveridge, DeGrandi & Weilacher

[57] ABSTRACT

A system for cooling an internal combustion engine having a turbocharger includes an engine coolant recirculating circuit and a turbocharger coolant recirculating circuit. Coolant is fed from the former recirculating circuit to the latter recirculating circuit. The turbocharger coolant recirculating circuit includes a coolant feeding tank at a higher position than those of the turbocharger and a radiator. Coolant is recirculated from a water jacket for the engine via a coolant intake pipe, a water jacket for the turbocharger, a coolant discharge pipe, the coolnt feeding tank, a coolant return pipe and the pump. Air in the both recirculating circuits is collected in an air venting portion of the radiator and then transferred to an air chamber in the feeding tank via an one-way valve.

2 Claims, 1 Drawing Sheet

SYSTEM FOR COOLING AN INTERNAL COMBUSTION ENGINE INCLUDING A TURBOCHARGER

BACKGROUND OF THE INVENTION

1. Technical Field

The present invention relates to a system for cooling an internal combustion engine having a turbocharger attached thereto and more particularly, to a cooling system for the turbocharger when the engine stops.

2. Description of the Related Art

A turbocharger for an internal combustion engine includes a turbine. As hot exhaust gas flows in the turbine, bearing lubricant is liable to be thermally degraded. To prevent a turbine rotor from being immovable under thermal influence due to insufficient lubrication, there has been made a proposal that a part of engine coolant is delivered to a water jacket for the turbocharger so as to cool bearings for the turbine rotor.

When the engine stops and thereby rotation of a pump for recirculating coolant is interrupted, coolant fails to be delivered to the water jacket for the turbocharger. This causes bearing portions for the turbocharger to be quickly heated up to an extremely high temperature. Consequently, it is unavoidable that bearing lubricant is thermally degraded due to the high temperature at the bearing portions in spite of the fact that lubricant remains at the bearings after the engine stops.

To obviate the foregoing problem, two prior inventions are disclosed, one of them being Japanese Laid-Open Patent NO. 219,419/1985 (hereinafter referred to as a first-mentioned prior invention) and the other one being Japanese Laid-Open Patent NO. 204,923/1985 (hereinafter referred to as a last-mentioned prior invention).

According to the first mentioned prior invention, a water jacket for the turbocharger is installed at a position substantially corresponding to the cooling portion of an engine cylinder head or higher than the portion, a coolant tank is installed at a position higher than that of the water jacket for the turbocharger and a coolant discharging passage extending from the water jacket is communicated with the interior of the coolant tank.

Steam generated in the water jacket for the turbocharger when the engine stops is brought in the coolant tank via the coolant discharging passage so that coolant in the coolant tank is fed to the water jacket for the turbocharger under the effect of respiration or it is fed to the water jacket for the turbocharger from a coolant passage for the engine via a coolant intake passage to cool bearing portions for the turbocharger.

On the other hand, according to the last-mentioned prior invention, when the engine stops, a solenoid valve in a delivery conduit is opened and hot coolant in the water jacket for the exhaust gas turbine in the turbocharger is transferred to a compensating tank (coolant tank) installed at a higher position than that of the turbocharger via the delivery conduit so as to cool it. After it is cooled, it is returned to an intake pipe leading to the water jacket for the exhaust gas turbine in the turbocharger. This prior invention discloses a thermo-siphoning that the exhaust gas turbine in the turbocharger is cooled by utilizing a so-called thermo-siphoning.

With either of the both prior inventions, steam generated in the water jacket for the turbocharger is transferred to an air chamber through the interior of the tank.

Consequently, with the first-mentioned prior invention, a part of steam containing air therein is induced into a radiator along with coolant in the tank.

With the last-mentioned prior invention, the steam which has been transferred to the air chamber in the coolant tank is induced into a heat exchanger along with air.

In this manner, steam containing air is unavoidably induced into the radiator according to either of the prior inventions. This leads to a problem that air lock occurs in a coolant pipe in the engine when the engine starts.

SUMMARY OF THE INVENTION

An object of the present invention is to provide a system for cooling an internal combustion engine having a turbocharger attached thereto wherein steam generated in the water jacket for the turbocharger after the engine stops while a vehicle is tilted in the forward direction on a declined road may smoothly be transferred to a coolant tank even under a condition that there is not provided a sufficient difference in height between an outlet pipe extending from the water jacket for the turbocharger and a highest outlet pipe on the engine side.

Other object of the present invention is to provide a system for cooling the internal combustion engine having the turbocharger attached thereto wherein recirculation of coolant through a turbocharger coolant recirculating circuit is improved by steam generated in the water jacket for the turbocharger.

Another object of the present invention is to provide a system for cooling the internal combustion engine having the turbocharger attached thereto wherein induction of the steam into the radiator can be prevented reliably.

The present invention provides a system for cooling the internal combustion engine having the turbocharger attached thereto wherein the system includes a pump driven by the engine, a water jacket provided for the engine to build an engine coolant recirculating circuit between the water jacket for the engine and a radiator, a water jacket provided for the turbocharger, the water jacket for the turbocharger being branched from the water jacket for the engine, and a coolant feeding tank of which water level is set to a a position higher than that of the turbocharger and an air venting portion at the upper part of the radiator, the coolant feeding tank including a turbocharger coolant recirculating circuit between the turbocharger and the pump, wherein the improvement is such that an air chamber is provided at the upper part of the coolant feeding tank, the air chamber being communicated with a coolant outlet of the water jacket for the turbocharger via a coolant discharge pipe, a coolant outlet opened to the interior of the coolant feeding tank at a bottom of the tank is communicated with a suction side of the pump via a coolant return pipe, and an air venting passage opened to the interior of the air chamber in the coolant feeding tank at a position higher than the water level in the coolant feeding tank is equipped with an one-way valve at an outlet opening portion thereof, an inlet of the air venting passage being communicated with the air venting portion of the radiator via an air venting pipe, wherein the the air chamber is arranged in the turbocharger coolant recirculating circuit.

With the above structure, vapor generated in the water jacket for the turbocharger when the engine stops can smoothly be transferred to the air chamber at the upper part of the coolant feeding tank. Although the steam flows into the air chamber of the coolant feeding tank, there is no fear that it is permeated into coolant in the coolant feeding tank.

Coolant in the coolant feeding tank is fed to the water jacket for the turbocharger via a coolant return pipe, a pump and a water jacket for the engine under balanced pressure between the turbocharger and engine coolant recirculating circuits.

An one-way valve mounted on the coolant feeding tank prevents the vapor flowing from the coolant jacket for the turbocharger from being transferred to the radiator side along with air in the air chamber.

Air brought into the engine coolant recirculating circuit when the coolant feeding tank is fed with coolant on stoppage of the engine can smoothly be discharged from the air venting portion of the radiator into the air chamber via an air venting pipe and the one-way valve. With the above structure, vapor generated in the water jacket for the turbocharger can smoothly be transferred to the air chamber in the coolant feeding tank when the engine is kept immovable, and thereby the turbocharger can be cooled by coolant fed from the coolant feeding tank under the effect of the balanced pressure between the turbocharger and engine coolant recirculating circuits. Consequently, coolant feeding and air removing can smoothly be achieved during a period of coolant feeding.

Other objects, feature and advantages of the present invention will become understood from the following description referring to the accompanying drawings.

BRIEF DESCRIPTION OF THE DRAWINGS

The present invention is illustrated in the following drawings in which.

DESCRIPTION OF THE PREFERRED EMBODIMENT

Now, the present invention will be described in detail hereinafter with reference to the accompanying drawings which illustrate a preferred embodiment thereof.

Figure 1:
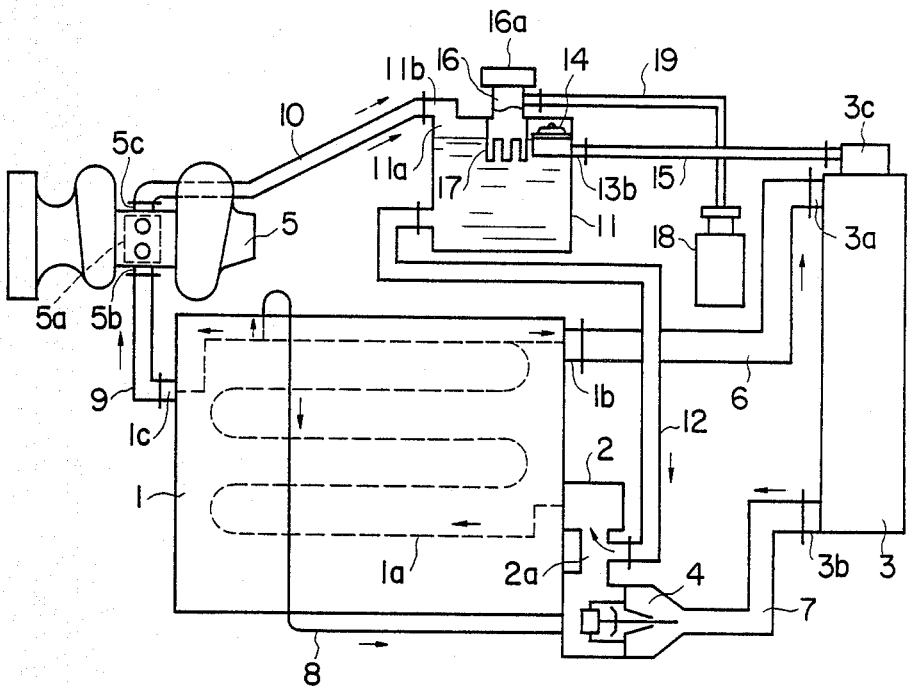
FIG. 1 is a schematic view illustrating a system for cooling an internal combustion engine having a turbocharger attached thereto in accordance with an embodiment of the present invention.

In FIG. 1, reference numeral 1 designates an engine, reference numeral 2 does a water pump, reference numeral 3 does a radiator, reference numeral 4 does a thermostat valve and reference numeral 5 does a turbocharger. The engine 1 is provided with a water jacket la which includes a coolant outlet 1*b*. The coolant outlet 1*b* of the water jacket 1*a* is communicated with a coolant inlet 3*a* of the radiator 3 via a cooling water intake pipe 6. The radiator 3 includes a coolant outlet 3*b* which is communicated with a suction side 2*a* of the water pump 2 via an inlet pipe 7 and the thermostat valve 4. An outlet pipe 8 branched from the water jacket 1*a* is connected to a downstream side of the thermostat valve 4. In such a manner, an engine coolant recirculating circuit is provided.

The water jacket 1*a* includes another coolant outlet 1*c* which is communicated with the coolant inlet 5*b* of a water jacket 5*a* for the turbocharger 5 via a coolant intake pipe 9. The water jacket 5*a* includes a coolant outlet 5*c* which is connected to the suction side 2*a* of the pump 2 via a coolant discharge pipe 10, a coolant feeding tank 11 disposed at a higher position than those of the turbocharger 5 and a coolant return pipe 12. In such a manner, a turbocharger coolant recirculating circuit is provided.

Figure 2:
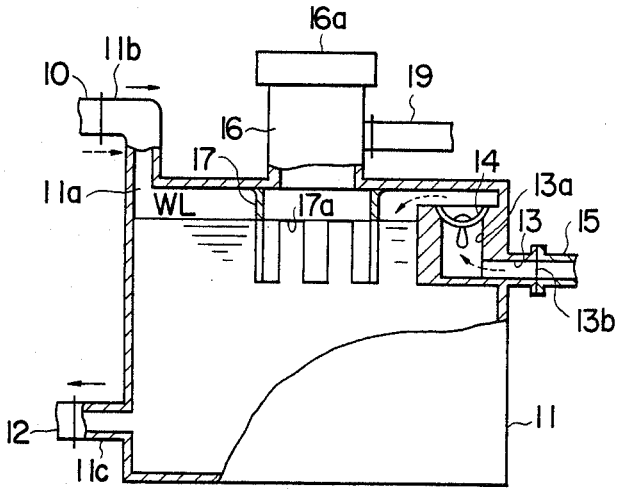
FIG. 2 is an enlarged sectional view illustrating a coolant feding tank of the present invention.

As shown in more detail in FIG. 2, the tank 11 has an air chamber 11*a* at the upper part thereof and a cooling water inlet 11*b* at the top of the air chamber 11*a* is communicated with the coolant outlet 5*c* of the water jacket 5*a* for the turbocharger 5 via the coolant discharge pipe 10. A coolant outlet 11*c* opened to the interior of the tank 11 at the bottom of the tank 11 is communicated with the suction side 2*a* of the pump 2 via the coolant return pipe 12.

The tank 11 is provided with an air venting passage 13 at a position opposite to the coolant inlet 11*b* and an outlet opening portion 13*a* of the air venting passage 13 is opened to the upper part of the air chamber 11*a* above the water level WL. The air venting passage 13 is equipped with an one-way valve 14 in the outlet opening portion 13*a*. An inlet 13*b* of the air venting passage 13 is communicated with an air venting portion 3*c* at the top of the radiator 3 via an air venting pipe 15.

The tank 11 is provided with an inlet pipe 16 at the upper central part thereof and the inlet pipe 16 is closed with a cap 16*a*.

Further, the tank 11 is provided with an annular skirt 17 depending from the upper wall thereof so as to surround the inlet pipe 16, and the annular skirt 17 is formed with a plurality of cutouts 17*a* to serve as water level detecting means for maintaining the water level WL to a predetermined one.

The side wall of the feeding pipe 16 is communicated with a reservoir tank 18 through a valve (not shown) attached to the cap 16*a* of the feeding pipe 16 via a pipe 19.

When the coolant has temperature lower than predetermined one while the engine is running, the thermostat valve 4 is closed, whereby the coolant in the engine coolant recirculating circuit is recirculated in accordance with the order as represented by the following steps: the water pump 2—the water jacket 1*a*—the cooling water pipe 8—the water pump 2, wherein the coolant in the turbocharger coolant recirculating circuit branched from the engine coolant recirculating circuit via the water jacket 1*a* is recirculated in accordance with the order as represented by the following steps: the water jacket 1*a* the coolant intake pipe 9—the water jacket 5*a*—the coolant discharge pipe 10—the feeding tank 11—the coolant return pipe 12—the pump 2.

When the coolant temperature rises up to a predetermined temperature, the thermostat valve 4 opens, whereby the coolant in the engine coolant recirculating circuit is recirculated in accordance with the order as represented by the following steps: the water pump 2—the water jacket 1*a*—the radiator inlet pipe 6—the radiator 3—the outlet pipe 7—the thermostat valve 4—the pump 2. With respect to the turbocharger coolant recirculating circuit, the coolant which has been cooled by the radiator 3 in the engine coolant recirculating circuit is recirculated therethrough. Consequently, the engine 1 and the turbocharger 5 are cooled by the coolant which has been cooled in that way.

When the engine 1 stops and thereby rotation of the pump 2 is interrupted, recirculating of the coolant is not performed by the pump 2. The temperature of the turbocharger 5 rises with the result that the temperature of the coolant in the water jacket 5*a* of the turbocharger 5 is raised up. As a consequence, steam is generated in the water jacket 5*a*. Since the tank 11 is disposed at a position higher than that of the turbocharger 5, the steam generated in the water jacket 5*a* is smoothly brought into the air chamber 11*a* of the tank 11 via the outlet pipe 10.

As the steam is induced into the air chamber 11*a*, the coolant in the tank 11 flows into the water jacket 1*a* of the engine 1 via the coolant return pipe 12 and the pump 2 by a balanced pressure between the turbocharger and the engine coolant recirculating circuits. Since the coolant is induced further into the water jacket 5*a* of the turbocharger 5 from the water jacket la of the engine 1 via the coolant intake pipe 9, bearing portions (not shown) of the turbocharger 5 may be cooled. At this moment, the one-way valve 14 is closed. This inhibits the steam in the tank 11 from flowing into the radiator 3 via the air venting pipe 15. Since the steam which has been induced into the tank 11 flows into the air chamber 11*a* into the cooling water without permeation, air bubbles each containing steam therein do not flow through the engine coolant recirculating circuit. Accordingly, there is no fear of causing malfunctions of air locking and cavitation in the pump 2.

To feed the turbocharger coolant recirculating circuit with coolant, the water level in the tank 11 is set to a position higher than the top of the radiator 3. Thus, when the tank 11 is fed with the coolant via the feeding pipe 16, the coolant is distributed into the both coolant recirculating circuits via the return pipes 12. Air or air bubble remaining in the coolant is collected in the air venting portion 3*c* of the radiator 3 and the air is then smoothly vented in the air chamber 11*a* of the tank 11 via the air venting pipe 15, the air venting passage 13 and the one-way valve 14.

As will be apparent from the above description, the present invention has provided a cooling system for an internal combustion engine having a turbocharger attached thereto, wherein an air chamber is provided at the upper part of a coolant feeding tank of which water level is set to a higher position than those of the turbocharger and the air venting portion of a radiator, the coolant outlet of a water jacket for the turbocharger is communicated with an air chamber in the tank via an outlet pipe, and an outlet connected to the tank at the bottom of the tank is communicated with the suction side of a pump via a return pipe, wherein the air chamber is arranged in the turbocharger coolant recirculating system.

With this cooling system, steam generated in the water jacket for the turbocharger when the engine stops can smoothly be transferred to the air chamber in the coolant feeding tank. Since the coolant feeding tank is installed at a higher position than those of the turbocharger and an air chamber is provided in the coolant feeding tank, steam generated in the water jacket for the turbocharger can smoothly be induced into the air chamber, even when the engine stops while a vehicle is tilted in the forward direction on a slope. This permits the coolant to be fed to the turbocharger by the balanced pressure between the turbocharger and engine coolant recirculating circuits so as to cool the engine, when the engine stops.

Further, since steam flows only into the air chamber of the tank without permeation of air into the coolant, there is no malfunctions such as air locking and cavitation in the pump and the coolant circuits.

The outlet opening portion of an air venting passage is equipped with an one-way valve at a higher position than that of the water level in the tank and an inlet of the air venting passage is communicated with an air venting portion of the radiator via an air venting pipe. This inhibits steam in the air chamber from being transferred to the radiator, whereby induction of air into the engine coolant recirculating circuit can be prevented and an occurrence of air locking and cavitation in the water pump can be prevented.

In addition, since air in the engine coolant recirculating circuit is discharged in the air chamber via the air venting portion at the upper part of the radiator as well as the one-way valve, feeding of the coolant can easily be performed and air in the engine coolant recirculating circuit can completely be removed therefrom.

While the presently preferred embodiment of the present invention has been shown and described, it should be understood that this disclosure is merely for the purpose of illustration and that various changes and modifications may be made without departure from the scope of the invention as set forth in the appended claims.

What is claimed is:

1. In a system for cooling an internal combustion engine having a turbocharger attached thereto wherein said system includes a pump driven by said engine, a water jacket provided for the engine including an engine coolant recirculating circuit between said water jacket for the engine and a radiator, a water jacket provided for said turbocharger, said water jacket for the turbocharger being branched from said water jacket for the engine, and a coolant feeding tank of which water level is set to a position higher than those of the turbocharger and an air venting portion at an upper part of said radiator, said coolant feeding tank including a turbocharger coolant recirculating circuit between the turbocharger and the water pump, the improvement comprising;

an air chamber provided at an upper part of the coolant feeding tank, said air chamber being communicated with an outlet of the water jacket for the turbocharger via an outlet pipe, an outlet connected to the tank at a bottom of the tank, said outlet being communicated with a suction side of the pump via a return pipe, an air venting passage connected to the air chamber in the tank at a higher position than the water level in the coolant feeding tank, said air venting passage being equipped with an one-way valve at an outlet opening portion thereof, an inlet of said air venting passage being communicated with said air venting portion of the radiator via an air venting pipe, and the air chamber being arranged in the turbocharger coolant recirculating circuit.

2. The system as claimed in claim 1, wherein the tank is provided with an annular skirt depending from an upper wall thereof so as to surround a pipe, said annular skirt being formed with a plurality of cutouts to serve as water level detecting means for maintaining the water level to a predetermined value or level.

* * * * *